United States Patent [19]

Still et al.

[11] 4,098,544

[45] Jul. 4, 1978

[54] SKI-TYPE STABILIZER FOR DRILLING APPARATUS, AND METHOD OF USE

[75] Inventors: Norman H. Still; Robert W. Berry, both of Brea, Calif.

[73] Assignee: Smith International, Inc., Newport Beach, Calif.

[21] Appl. No.: 787,284

[22] Filed: Apr. 13, 1977

[51] Int. Cl.[2] ..... F16C 1/26

[52] U.S. Cl. ..... 308/4 A; 166/241

[58] Field of Search ..... 308/4 A, 4 R, 6 A, 3.9, 308/6 R, 15, 189; 175/220, 325; 166/241

[56] References Cited

U.S. PATENT DOCUMENTS

| | | | |
|---|---|---|---|
| 2,696,367 | 12/1954 | Robishaw | 308/4 A X |
| 2,971,582 | 2/1961 | Marsh | 166/241 |
| 3,933,203 | 1/1976 | Evans | 166/241 |

*Primary Examiner*—Trygve M. Blix
*Assistant Examiner*—Douglas C. Butler

[57] ABSTRACT

Apparatus for aligning, supporting and stabilizing a drill string within a hole that is being drilled includes three elongated ski-like members which are disposed in circumferentially spaced positions about the drill string and in supporting engagement with the hole wall. Rotating bearing structures carried by the drill string are secured to the interior side of the ski-like members. The ski-like members are made in a number of longitudinal sections that are removably fastened together.

According to the disclosed method, as the drill string is being extended and driven into the hole the ski-like members are assembled a section at a time and in such manner as not to interfere with the extension of the drill string.

8 Claims, 8 Drawing Figures

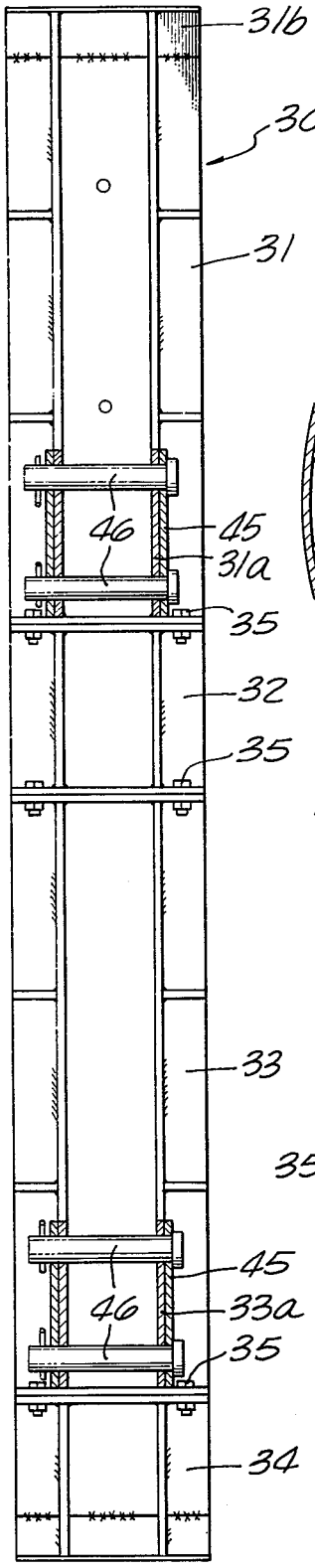
FIG. 4.
FIG. 5.
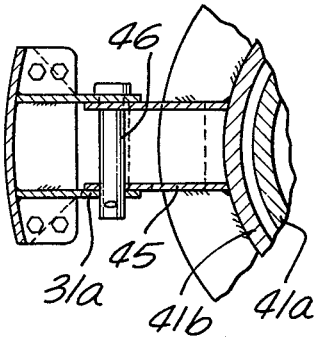
FIG. 6.
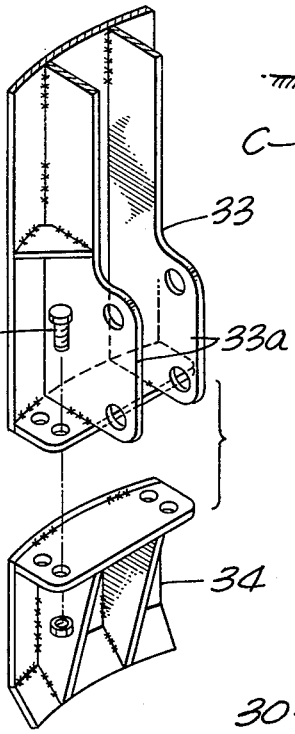
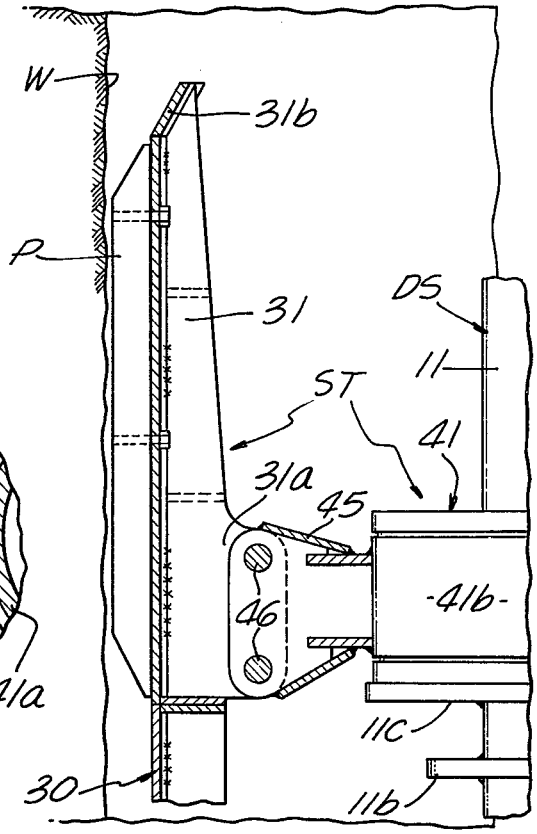
FIG. 7.
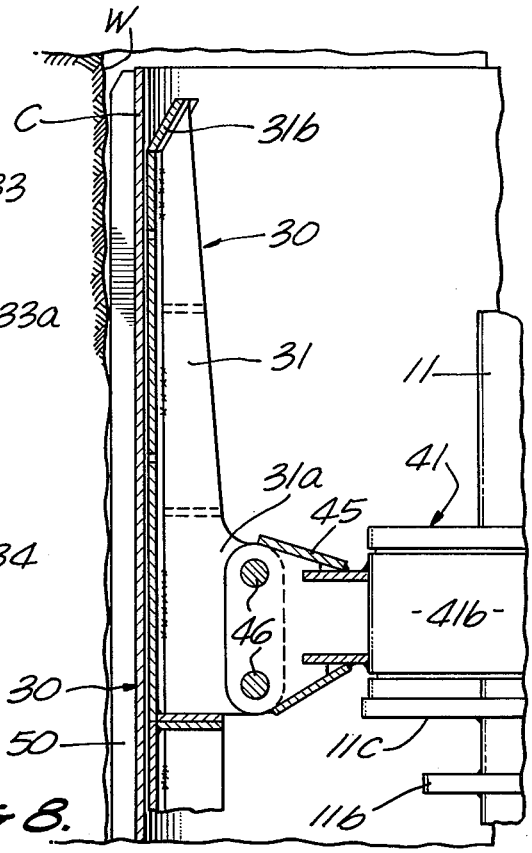
FIG 8.

SKI-TYPE STABILIZER FOR DRILLING APPARATUS, AND METHOD OF USE

BACKGROUND OF THE INVENTION

The use of stabilizers for the purpose of supporting a drill string from the wall of a hole being drilled is well-known in the art. The stabilizer of the present invention has been developed for the specific purpose of drilling a hole upwardly, and casing the hole substantially concurrently with the drilling thereof.

SUMMARY OF THE INVENTION

Stabilizer apparatus in accordance with the present invention includes a plurality of ski-like members which are placed in circumferentially spaced positions about a drill string, and disposed parallel thereto, so as to engage the walls of a hole that is being drilled. Bearing means placed inside the ski-like members includes an inner bearing part that is secured to the drill string, a relatively rotatable outer bearing part, and means securing the inner sides of all the ski-like members to the outer bearing part. Thus, all of the ski-like members are maintained in fixed positions relative to each other, and will engage the wall of the hole being drilled and slide longitudinally therealong, while the drill string is being drivingly rotated as well as advancing longitudinally within the hole.

According to the presently preferred form of the invention the stabilizer apparatus is of sufficient length to encompass two adjoining drill stem sections. Separate rotating bearing means are secured to the two drill stem sections. The two bearing outer parts are secured to the ski-like members near respective ends thereof.

More specifically, according to the present invention a modified form of drill stem is utilized for carrying the stabilizer apparatus. Each drill stem has a first circumferential flange near one of its ends which is selectively engaged by a hair pin assembly for purpose of supporting the entire drill string. Each drill stem section is also provided with a second circumferential flange, spaced longitudinally inwardly from the first flange, and to which the inner bearing part referred to above is secured. The encompassing portion of the ski-like members includes a first longitudinal section which surrounds the second circumferential flange of the drill stem but not the first. It also includes a second section which surrounds the first circumferential flange but not the second.

According to the novel method of the present invention the ski-like members of the stabilizer assembly are installed one section at a time, in such manner as not to interfere with the extension of the drill string. Specifically, the bearing means and a first section of the ski-like members are secured to the second circumferential flange of a particular drill stem section; the first circumferential flange of that section is then engaged by the hair pin assembly in order to support the drill string; and after a new drill stem section has been added to the drill string and the hair pin assembly has been disengaged, the second sections of the ski-like members are then attached to the first sections thereof.

DRAWING SUMMARY

FIG. 4 is an elevational view of the interior side of one of the skis, with its supporting mechanism shown in cross-section, taken on line 4—4 of FIG. 3;

FIG. 5 is a detail cross-sectional view taken on the line 5—5 of FIG. 3;

FIG. 6 is a perspective view of two longitudinal sections of a ski showing how they would be fitted together;

FIG. 7 is a cross-sectional elevational view showing a spacer pad attached to one of the skis; and FIG. 8 is a cross-sectional view like FIG. 7, but showing the stabilizer ski without the spacer pad, and being located inside the casing rather than inside the otherwise bare hole.

PREFERRED EMBODIMENT

Reference is now made to the drawings, FIGS. 1 through 8, inclusive, illustrating the presently preferred embodiment of the invention. In the present drawings the invention is disclosed as being utilized in the drilling of a hole upwardly.

The circumferential wall W of the hole is of sufficient diameter to accept a casing C, FIG. 8. The ski-like members 30 of the stabilizer apparatus ST have sufficient radial extension from the center of the hole so as to engage the interior surface of the casing C, when the casing is in the hole. See FIG. 8. When the casing is not in the hole, however, pads P, shown in dotted lines in FIGS. 1 and 2 and in solid lines in FIG. 7, are secured to the exterior surfaces of the ski-like members for occupying the space that would otherwise be occupied by the casing. At various times in this description reference is made to the fact that the outer surfaces of the ski-like members slide longitudinally along the hole wall, and it will be understood that this is intended to refer equally to the situation where the ski-like members directly engage the interior surface of casing C, and to the situation where the ski-like members are extended or enlarged by means of pads P in order to engage the bare rock or earthen wall of the hole itself.

Figure 1:
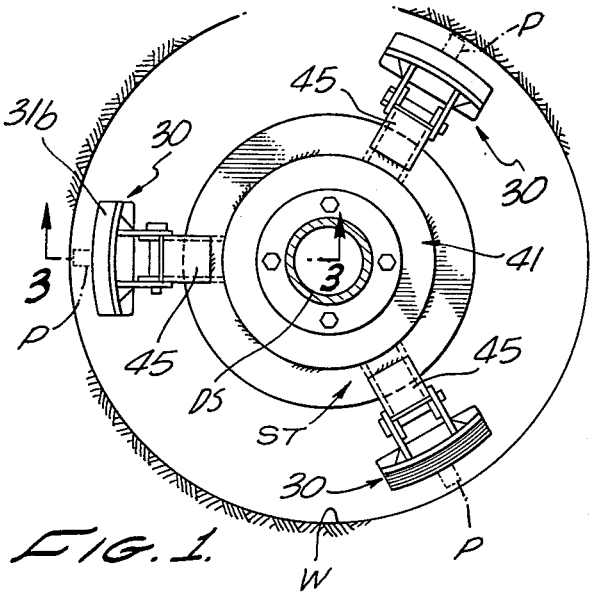
FIG. 1 is a top plan view of a ski-type stabilizer in accordance with the present invention, in place in a hole that is being drilled.
Figure 2:
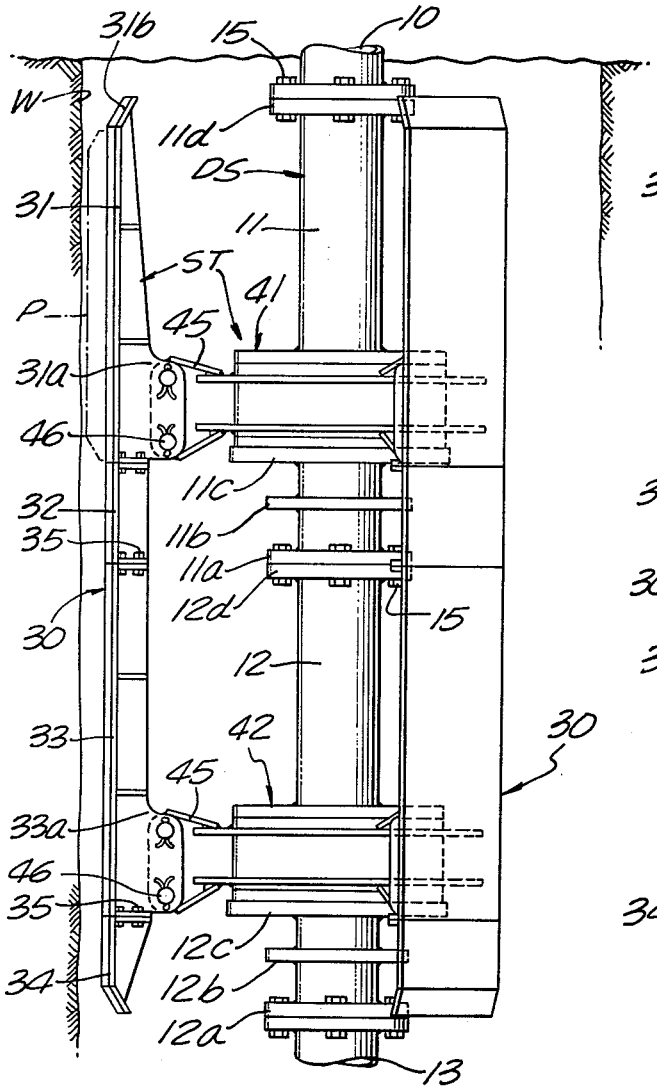
FIG. 2 is an elevational view of the stabilizer of FIG. 1.
Figure 3:
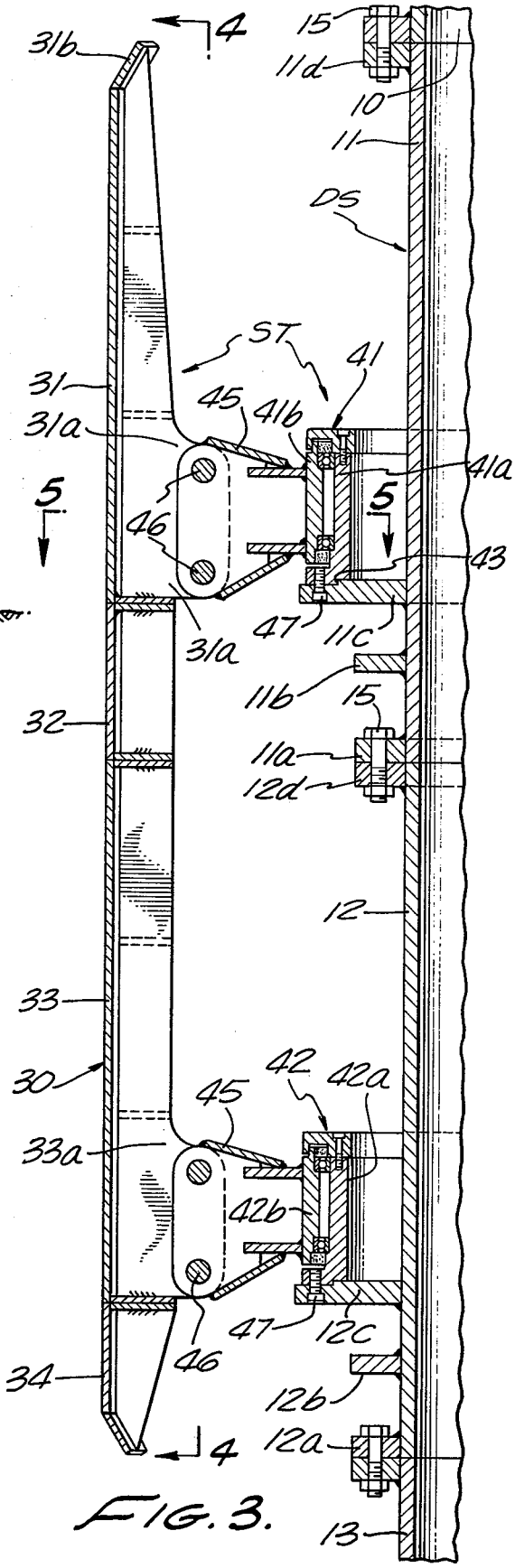
FIG. 3 is a cross-sectional elevational view on an enlarged scale of the stabilizer of FIG. 1, taken on line 3—3 of FIG. 1.

Drill string DS includes a series of drill stem sections which are secured together in end-to-end relationship, as best seen in FIGS. 2 and 3. Only a fragmentary portion of the uppermost drill stem section 10 is shown, and beneath it are the succeeding sections 11 and 12 and then a lowermost section 13 which is only partially shown. Referring specifically to the drill stem section 11, it is equipped with a lower end flange 11*a* and an upper end flange 11*d*, and as seen in FIG. 2 the radial extension of these end flanges is relatively small compared to the diameter of the drill stem section itself. Specifically, these end flanges are made of sufficient radial extent to receive the bolts 15 which are utilized for removably securing the ends of adjoining drill stem sections together.

Drill stem section 11 also has a support flange 11*b* which is spaced longitudinally inwardly from the lower end flange 11*a*. The radial extent of support flange 11*b* is the same as that of the end flange. With the interior diameter of casing C being typically about four feet, and the diameter of each drill stem section being typically about eight inches, the radial extent of the end flanges is about two inches.

Spaced further inwardly on the drill stem section 11 is another support flange 11c, having a radial extent about double that of the end flanges, or about 4 inches. Support flange 11c is utilized for the attachment thereto of the cylindrical bearing assembly 41, FIG. 3.

Drill stem section 12 is constructed in the same fashion as drill stem section 11, its corresponding flanges being designated as 12a, 12b, 12c, 12d, respectively.

Drill stem section 10, shown only in part, is preferably not identical to sections 11 and 12, and is instead the drill stem that is directly attached to a collapsible cutterhead, as shown in our copending application Ser. No. 787,283 filed 4-13-77 and assigned to the same assignee as this present application. For purpose of supporting the stabilizer apparatus ST, therefore, drill stem section 11 is referred to in this description as the first drill stem section, while section 12 is referred to as the second drill stem section.

The stabilizer apparatus ST as presently illustrated includes three of the ski-like members 30, and it will be understood that in general there must be two or any larger plurality of such members. The presently preferred number of ski-like members is three, as being somewhat more advantageous than only two, and also somewhat more advantageous than four or any larger number. Since all of the ski-like members are identical to each other and are symmetrically located within the stabilizer apparatus ST, the same reference numeral 30 is used for each of them.

Each ski-like member is made in a series of four longitudinal sections 31, 32, 33, 34, respectively, as best seen in FIGS. 2 and 3. The uppermost section 31 extends from the upper end of the first drill stem section 11 to the bottom surface of support flange 11c. It has a support bracket 31a on the interior side of its lower end. Its upper extremity 31b is angled inwardly in a ski-like fashion. All three of the sections 31 of the ski-like members are rigidly supported relative to each other and at the same time are rotatably supported relative to the drill stem section 11.

Specifically, a cylindrical bearing assembly 41 has an inner part 41a which is secured to the support flange 11c. Support flange 11c has a circumferential shoulder 43 on its upper surface, FIG. 3, which receives the bearing inner part 41a in concentric relationship to the drill string. Screws 47, inserted from the underside of support flange 11c, are used to removably attach the bearing inner part 41a in place. Bearing outer part 41b is firmly supported by the bearing inner part, except for being rotatable around the longitudinal axis of the drill string. A set of three equally spaced brackets 45 (FIGS. 1, 2 and 3) are permanently mounted on the outer circumferential surface of the bearing part 41b. Each of the bearing brackets 45 is, in turn, removably secured by means of pins or bolts 46 to the interior bracket 31a of a corresponding section 31 of one of the ski-like members 30.

Each section 33 has an interior bracket 33a on its lower end. Cylindrical bearing assembly 42 is constructed identically to the bearing assembly 41, having inner part 42a and outer part 42b. The inner bearing part 42a is centered upon the support flange 12c of drill stem section 12 and removably secured thereon by the screws 47. Bearing outer part 42b carries three of the brackets 45 which are secured by means of removable pins or bolts to the interior brackets 33a of the stabilizer sections 33.

It will be noted that each stabilizer section 32 is of rather small length, extending only from the lower surface of support flange 11c to the lower surface of end flange 11a. Each stabilizer section 34 is of equally small length, extending from the lower surface of support flange 12c to the lower surface of end flange 12a. Stabilizer section 34 is angled inwardly on its lower end to provide the lower extremity of the ski-like members.

The method of initially assembling the stabilizer apparatus to the drill string is as follows. The interior diameter of the bearing inner part 42a is large enough to slip over the exterior diameter of the upper end flange 11d of drill stem section 11. While the bearing assembly 41 is capable of being disassembled, it is not normally disassembled at the construction site, but rather is used as an integral unit. Therefore, the entire bearing assembly 41 is slipped over the upper end flange 11d of drill stem section 11 and placed in its centered relationship upon the support flange 11c, where it is secured in place. After that has been done the drill stem section 11 may be secured to the lower end of drill stem section 10, in the conventional fashion.

The next step is to attach the stabilizer sections 31 to brackets 45 of the bearing assembly 41. The drill string may then be raised, and may be temporarily supported by engagement of a hair pin assembly, not shown, with the under surface of support flange 11b. Bearing assembly 42 is then slipped over the upper end flange 12d of drill stem section 12 and secured to the support flange 12c. Then the stabilizer sections 33 are secured by means of their brackets 33a to the support brackets 45 of bearing assembly 42.

Then the hair pin assembly is disengaged from support flange 11b. The gaps between stabilizer sections 31 and 33 are then filled by inserting the short sections 32. Sections 32 are then secured by bolting them in end-to-end relationship both to the section above and the section below. As best seen in FIG. 2 the bolts 35 used for this purpose are accessible from the interior side of the stabilizer member.

The drill string may then be raised again, and be supported on the hair pin assembly by engaging the under surface of support flange 12c of drill stem section 12. After drill stem section 12 has been added, and the drill string is raised a further amount, the last sections 34 of the stabilizer members may then be put in place so as to complete the stabilizer structure.

As best seen in FIG. 4 the configuration of the brackets 45 and 31a is such to provide structural support at four separate points when the pins or bolts 46 are inserted in place. The same is true with regard to brackets 33a. FIG. 5 shows a further detail of this arrangement.

As shown in FIG. 6, the stabilizer section 33 includes a parallel pair of internal braces, and a flat lower end plate. Stabilizer section 34 also has parallel interior braces and a flat upper end plate. The two end plates abut directly together and are secured by the bolts 35. The stabilizer sections 31 and 32 are similarly constructed, as best seen in FIGS. 2, 3, and 4.

In the present illustration the hole W is cut to somewhat larger diameter than the circumferential wall of casing C, which as shown in FIG. 8 is therefore provided with longitudinal ribs 50 on its exterior surface.

The invention has been described in considerable detail in order to comply with the patent laws by providing a full public disclosure of at least one of its forms. However, such detailed description is not intended in any way to limit the broad features or principles of the invention, or the scope of patent monopoly to be granted.

What is claimed is:

1. In a drill stem assembly for drilling a hole in the earth, the combination of apparatus comprising:

first and second drill stem sections secured together in end-to-end relationship, each of said drill stem sections having a first circumferential flange secured thereon near one of its ends and a second circumferential flange secured thereon and spaced longitudinally inwardly from said first flange;

first and second rotating bearing means each having inner and outer parts, said bearing inner parts being secured to said second flanges of said two drill stem sections, respectively;

three elongated ski-like members whose length is substantially equal to the combined length of said two drill stem sections, said members being disposed parallel to each other and to said drill stem sections and being circumferentially spaced in an annular arrangement so that their outer surfaces engage the wall of the hole; and means securing each of said outer bearing parts to the inner sides of said ski-like members for supporting them from said drill stem sections.

2. Apparatus as in claim 1 wherein each of said ski-like members is made in four separate longitudinal sections which are detachably secured together;

said bearing outer parts being secured to the first and third longitudinal sections of all of said ski-like members, respectively;

said second sections of said ski-like members being removably from said first and third sections in order to supportingly engage said first flange of said first drill stem section; and said fourth sections of said ski-like members being removable from said third sections for purpose of supportingly engaging said first flange of said second drill stem section.

3. Apparatus for aligning a drill stem within a hole being drilled in the earth, and for supporting and stabilizing the drill stem while it is rotatably driven and also advances longitudinally of the hole, said apparatus comprising:

a generally cylindrical bearing assembly having relatively rotatable inner and outer parts, said inner bearing part being disposed about the drill stem;

means for releasably securing said bearing inner part to the drill stem including support flange means on the drill stem;

a plurality of ski-like members disposed parallel to and in circumferentially spaced positions around the drill stem, each said ski-like member comprising a plurality of detachable sections; and means securing all of said ski-like members to said outer bearing part;

whereby as the drill stem rotates and concurrently advances, said ski-like members engage the wall of the hole and move longitudinally therealong but without rotation.

4. Apparatus as in claim 3 wherein the drill stem includes at least two drill stem sections and at least two such bearing assemblies, each bearing assembly being secured to a corresponding one of the drill stem sections, and the outer bearing part of each bearing assembly being secured at a different longitudinal position on said ski-like members.

5. Apparatus for stabilizing a drill string that includes a series of separate drill stem sections, while drilling a hole in the earth, said apparatus comprising:

a plurality of elongated ski-like members disposed in parallel relationship to each other and to the drill string and circumferentially spaced in an annular arrangement so that their outer surfaces longitudinally engage the wall of the hole;

first and second rotatable bearing members disposed concentrically within said ski-like members in longitudinally spaced positions, each of said bearing means being individually and removably attached to a respective drill stem section of the drill string by being installed over an end flange thereof and seated and fixed to a support flange thereon; and means securely fastening each of said bearing means to the inner sides of all of said ski-like members for supporting the same;

whereby as the drill string rotates and advances longitudinally within the hole, said ski-like members do not rotate but supportingly engage the wall of the hole and slide longitudinally therealong.

6. Apparatus as in claim 5 wherein each of said ski-like members is formed in a series of separate longitudinal sections, said sections being removably attached together by means of bolts which are accessible from the interior side of said ski-like members.

7. Apparatus as in claim 6 wherein each of said ski-like members includes four separate sections, said first and second bearing means being secured to alternate ones of said sections.

8. In the art of drilling a hole in the earth, the method of aligning and stabilizing a drill stem section concentrically within a hole being drilled, the method comprising:

securing two separate circumferential flanges to the drill stem section in longitudinally spaced positions thereon;

selecting at least three ski-like members each of which is formed in two longitudinal sections, so as to provide two sets of said sections;

placing one set of said sections for each ski-like member in parallel, circumferentially disposed positions about the drill stem section so that they longitudinally overlap one of said flanges but not the other;

securing said one set of sections to said ski-like members to said first-named flange in rotatable relationship thereto;

grasping said drill stem section by means of its other flange for the purpose of supporting same while another drill stem section is being attached thereto;

after the attachment operation has been completed, placing the other set of said sections for each ski-like member in parallel relationship to the drill stem section, circumdisposed about said other circumferential flange thereof, and in longitudinally aligned relationship to the respective sections of said first set; and then detachably securing the pairs of sections together.

* * * * *